US007821146B2

(12) United States Patent
Wanner

(10) Patent No.: US 7,821,146 B2
(45) Date of Patent: Oct. 26, 2010

(54) PARALLEL STARTING SYSTEM HAVING A LOW WIRING EXPENDITURE

(75) Inventor: Hartmut Wanner, Herrenberg-Oberjesingen (DE)

(73) Assignee: Robert Bosch GmbH, Stuttgart (DE)

( * ) Notice: Subject to any disclaimer, the term of this patent is extended or adjusted under 35 U.S.C. 154(b) by 74 days.

(21) Appl. No.: 11/883,693

(22) PCT Filed: Dec. 14, 2005

(86) PCT No.: PCT/EP2005/056787

§ 371 (c)(1),
(2), (4) Date: Apr. 24, 2008

(87) PCT Pub. No.: WO2006/084521

PCT Pub. Date: Aug. 17, 2006

(65) Prior Publication Data

US 2008/0283012 A1 Nov. 20, 2008

(30) Foreign Application Priority Data

Feb. 11, 2005 (DE) ..... 10 2005 006 248

(51) Int. Cl.
*F02N 11/00* (2006.01)

(52) U.S. Cl. ..... 290/36 R; 123/179.1

(58) Field of Classification Search ..... 290/38 R; 123/179.1

See application file for complete search history.

(56) References Cited

U.S. PATENT DOCUMENTS

| | | | | | |
|---|---|---|---|---|---|
| 2,115,671 | A * | 4/1938 | Pfister | ..... | 290/38 A |
| 2,930,901 | A * | 3/1960 | Freeman | ..... | 290/38 R |
| 4,170,211 | A * | 10/1979 | Worthington | ..... | 123/179.3 |
| 4,745,348 | A * | 5/1988 | Young | ..... | 318/749 |
| 5,095,864 | A * | 3/1992 | Bolenz et al. | ..... | 123/179.1 |
| 6,049,188 | A * | 4/2000 | Smith | ..... | 318/786 |
| 6,240,890 | B1 | 6/2001 | Abthoff et al. | | |
| 7,224,557 | B2 * | 5/2007 | Kinsella et al. | ..... | 361/2 |
| 7,443,044 | B2 * | 10/2008 | Shimazaki et al. | ..... | 290/38 R |
| 2005/0013085 | A1 * | 1/2005 | Kinsella et al. | ..... | 361/162 |

FOREIGN PATENT DOCUMENTS

| | | | |
|---|---|---|---|
| DE | 144 091 | | 9/1980 |
| DE | 144091 | A1 * | 9/1980 |
| DE | 205963 | A * | 1/1984 |
| EP | 0 419 497 | | 9/1992 |
| EP | 419497 | B * | 9/1992 |
| EP | 0 583 630 | | 2/1994 |
| EP | 583630 | A1 * | 2/1994 |
| GB | 451212 | A * | 2/1935 |
| GB | 451 212 | | 7/1936 |
| GB | 1 462 382 | | 1/1977 |
| GB | 1462382 | A * | 1/1977 |
| GB | 2114827 | A * | 8/1983 |
| JP | 10014184 | A * | 1/1998 |
| JP | 11115617 | A * | 4/1999 |
| JP | 11 115617 | | 7/1999 |

* cited by examiner

*Primary Examiner*—Joseph Waks
(74) *Attorney, Agent, or Firm*—Kenyon & Kenyon LLP

(57) ABSTRACT

A starter system for starting internal combustion engines including a plurality of starters connected in parallel, each having a starter motor and an engaging relay. This parallel starting system may be implemented simply and cost-effectively if at least one of the starters includes a power relay which switches the primary current path to the associated starter motor, and the engaging relay, the power relay, and the starter motor are implemented as a structural unit.

6 Claims, 7 Drawing Sheets

PARALLEL STARTING SYSTEM HAVING A LOW WIRING EXPENDITURE

FIELD OF THE INVENTION

The present invention relates to a parallel starting system for starting internal combustion engines.

BACKGROUND INFORMATION

Normally, electrically operated starters are used for starting internal combustion engines. In large engines having several tens or hundreds of liters of displacement such as, for example, marine engines, it is known to connect a plurality of starters in parallel to be able to provide the high starter power.

FIG. 1 shows a parallel starting system from the related art having two starters 1*a*, 1*b*. Each of the starters includes a starter motor 2*a*, 2*b* and an engaging relay 4*a*, 4*b* which normally performs two functions. On the one hand, engaging relay 4*a*, 4*b* engages a pinion (not shown) driven by starter motor 2*a*, 2*b* with a ring gear of the internal combustion engine. On the other hand, engaging relay 4*a*, 4*b* closes a primary current path 8 via a normally open contact 5*a*, 5*b* when the pinion has engaged with the ring gear. This begins the actual starting operation.

To prevent one of the two starters 1*a*, 1*b* from beginning the starting operation earlier than the other, both starters 1*a*, 1*b* are interconnected in such a way that primary current path 8 to starter motors 2*a*, 2*b* is not closed until both pinions are engaged or both engaging relays 4*a*, 4*b* have completely pulled up. The two engaging relays 4*a*, 4*b* are in this case connected in parallel with respect to their control terminal and are connected to a terminal 50 which is connected to the starter switch (switch 6). The load terminals (terminals 30, 30*b*) of engaging relays 4*a*, 4*b* are, however, interconnected in series. Terminal 30 of first starter 1*a* is connected to a battery which supplies it a voltage U+.

In a starting operation, i.e., after ignition 6 is activated, windings HW (holding winding) and EW (pull-in winding) of engaging relays 4*a*, 4*b* are supplied with current. As a result, both engaging relays 4*a*, 4*b* pull in, switches 5*a*, 5*b* being closed. When both switches 5*a*, 5*b* are closed, both starter motors 2*a*, 2*b* are supplied with current simultaneously and start the internal combustion engine. It is a disadvantage in this case that both engaging relays 4*a*, 4*b* must switch and conduct the same current for both starter motors 2*a*, 2*b*. Noise-contaminated actuating signals (signal bounce) can therefore result in high contact erosion and a high risk of contact welding exists.

SUMMARY OF THE INVENTION

An object of the present invention is therefore to improve the switching reliability. A further object of the present invention is to develop a parallel starting system that can be wired using minimum complexity. This object is achieved according to the present invention.

An important idea of the present invention is to separate the customary concatenation of the functions "engage" and "switch primary current" of conventional engaging relays and instead provide two relays, one of which (engaging relay) performs the function "engage" and the other (power relay) exclusively performs the function "switch primary current." The engaging relay and the power relay are preferably designed as a structural unit together with the associated starter motor. This makes it possible to devise a parallel starting system that may be wired in a simple and low-cost manner and in which the power relay need not be designed for excessively high loads.

The starters are preferably interconnected in such a way that the power relays do not switch the primary current to the starter motors until all engaging relays have pulled up (i.e., all pinions have engaged or the engaging springs are under tension).

According to a first embodiment (FIG. 2) of the present invention, the engaging relays of two starters are connected with one another in series. This means the control terminal of the subsequent engaging relay is connected to the load terminal of the preceding engaging relay. The load terminals of the engaging relays are preferably connected to terminal 30. If the engaging relays are connected in series, relatively high current flows to the second engaging relay, making a relatively thick connecting cable between the starters necessary.

According to a second embodiment (FIG. 4) of the present invention, the engaging relays of two starters are connected in parallel with respect to their control terminals. The load terminals of the engaging relays are preferably connected in series, the first load terminal preferably being connected to terminal 30. The load terminal of the last engaging relay is preferably interconnected with the control terminal (50*k*) of a power relay. The power relays are preferably connected in parallel. The advantage of the series connection of the load terminals is that the flow of current between two starters is substantially lower.

According to a preferred embodiment of the present invention, each of the starters has its own power relay which switches the flow of current to the starter motor. Optionally, at least one of the starters may also not have its own power relay (FIG. 5). In this case, this engaging relay performs both functions, namely "engage" and "switch primary current."

Preferably, a three-pole connection is provided between two starters connected in parallel. If the connecting cable of a starter has a plug connection, it is possible to connect a plurality of starters in a simple manner. When wiring the starters, it is only necessary to take note of the position of the starter in question in the chain of starters.

DETAILED DESCRIPTION

Figure 1:
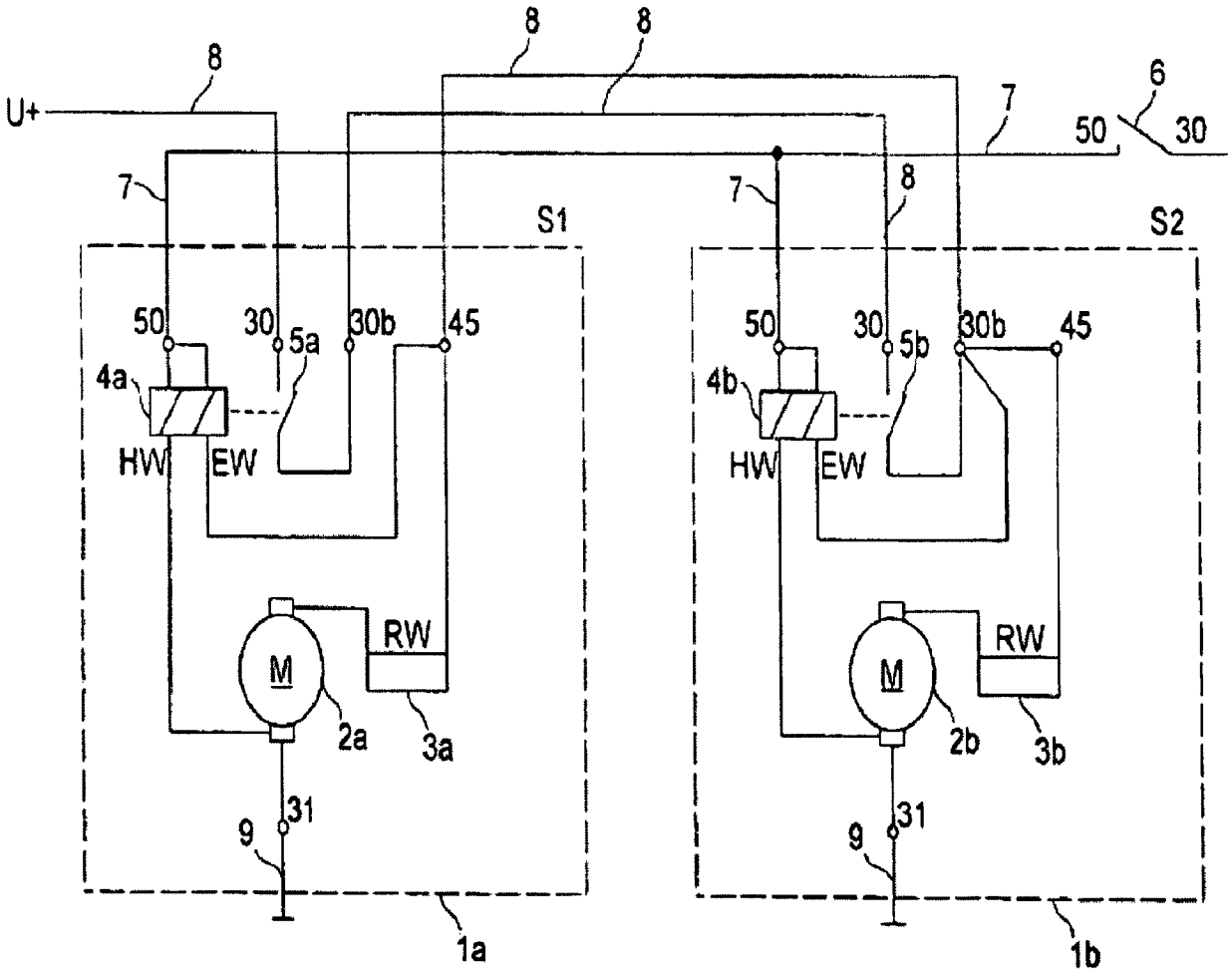
Fig. 1 (Prior Art)
FIG. 1 shows the electrical circuit diagram of a parallel starting system known from the related art.

With respect to the explanation of FIG. 1, reference is made to the introduction of the background information.

Figure 2:
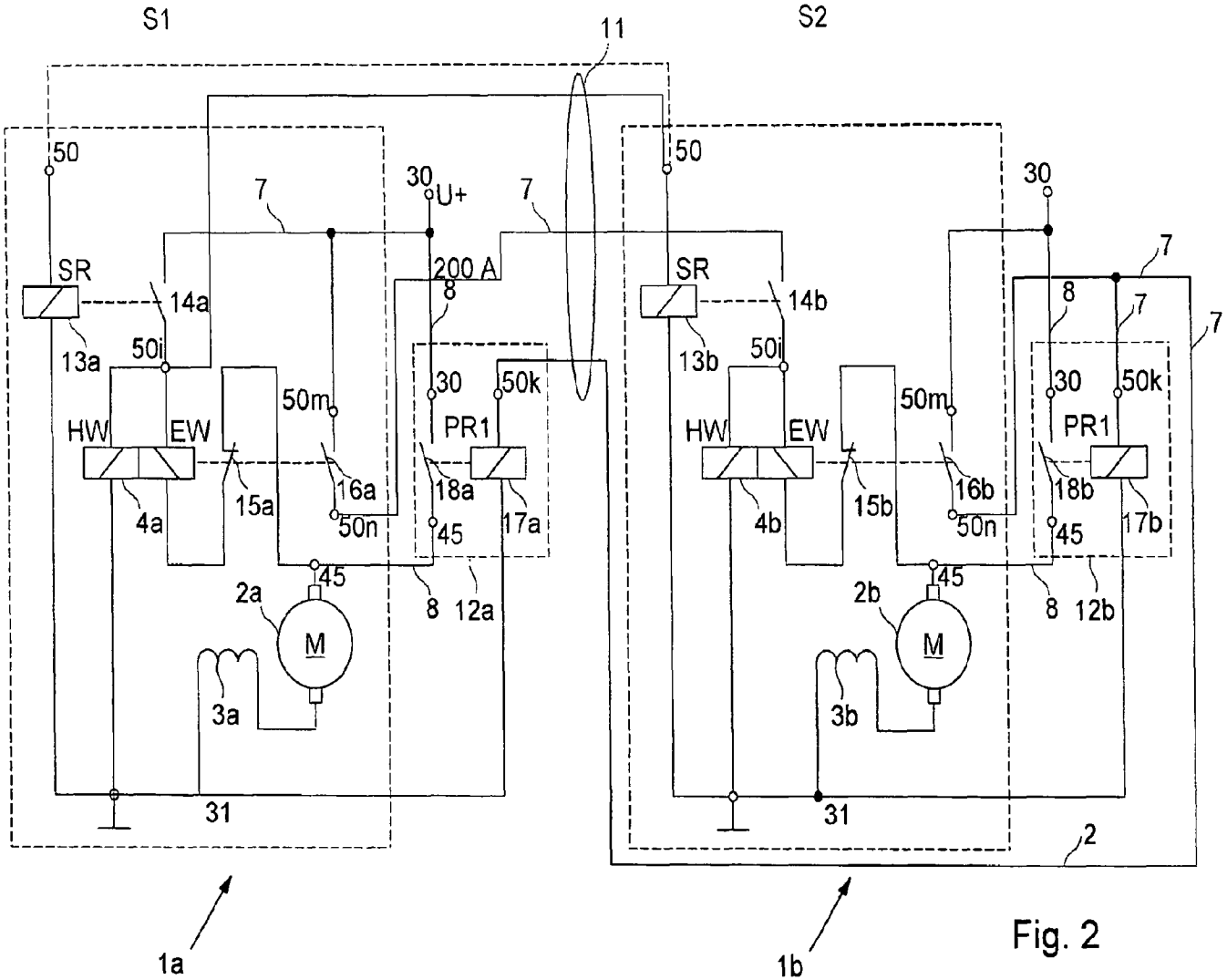
FIG. 2 shows the circuit diagram of a parallel starting system according to a first embodiment of the present invention.

FIG. 2 shows a parallel starting system having two starters 1*a*, 1*b*. Each of starters 1*a*, 1*b* has a starting relay 13*a*, 13*b*, an engaging relay 4*a*, 4*b*, a power relay 12*a*, 12*b* and a starter motor 2*a*, 2*b*. The primary current of starter motors 2*a*, 2*b* is switched by power relays 12*a*, 12*b*. Engaging relays 4*a*, 4*b* are used only for engaging the pinion (not shown) with the ring gear and providing the starting current.

In a starting operation, starting relays 13*a*, 13*b*, which are connected in parallel and connected to terminal 50, pull in simultaneously and close associated switches 14*a*, 14*b*. This closes a current path 7 between terminal 30 and terminal 50*i* and current is supplied to the control terminal of both engaging relays 4*a*, 4*b*. In this case, engaging relays 4*a*, 4*b* are connected in series, i.e., the control terminal of engaging relay 4*b* is connected with the load terminal (terminal 50*n*) of engaging relay 4*a*. Therefore, switch 16*a* of first engaging relay 4*a* closes first and after that, switch 16*b* of second engaging relay 4*b* closes. The load terminals (terminal 50*m*) of the two engaging relays 4*a*, 4*b* are connected to terminal 30.

The load terminal (terminal 50*n*) of second engaging relay 4*b* is interconnected with the control terminals (terminal 50*k*) of power relays 12*a*, 12*b*. Closing second switch 16*b* therefore causes current to be supplied to the control terminals of power relays 12*a*, 12*b*. Power relays 12*a*, 12*b* are connected in parallel in this case. As a result, both associated switches 18*a*, 18*b* close approximately simultaneously and close the current path 8 between terminal 30 and terminal 45 of starter motors 2*a* and 2*b*, respectively. The internal combustion engine (not shown) is thus started approximately simultaneously by both starter motors 2*a*, 2*b*.

The two starters 1*a*, 1*b* in this case are connected with one another by a three-pole electrical line 11. A relatively high current of, e.g., 200 A, which is necessary for actuating relay 4*b*, flows between terminal 50*n* and 50*i* via control line 7. In the parallel starting system shown in FIG. 4, this current is substantially reduced, making it possible to use a thinner cable.

Figure 3:
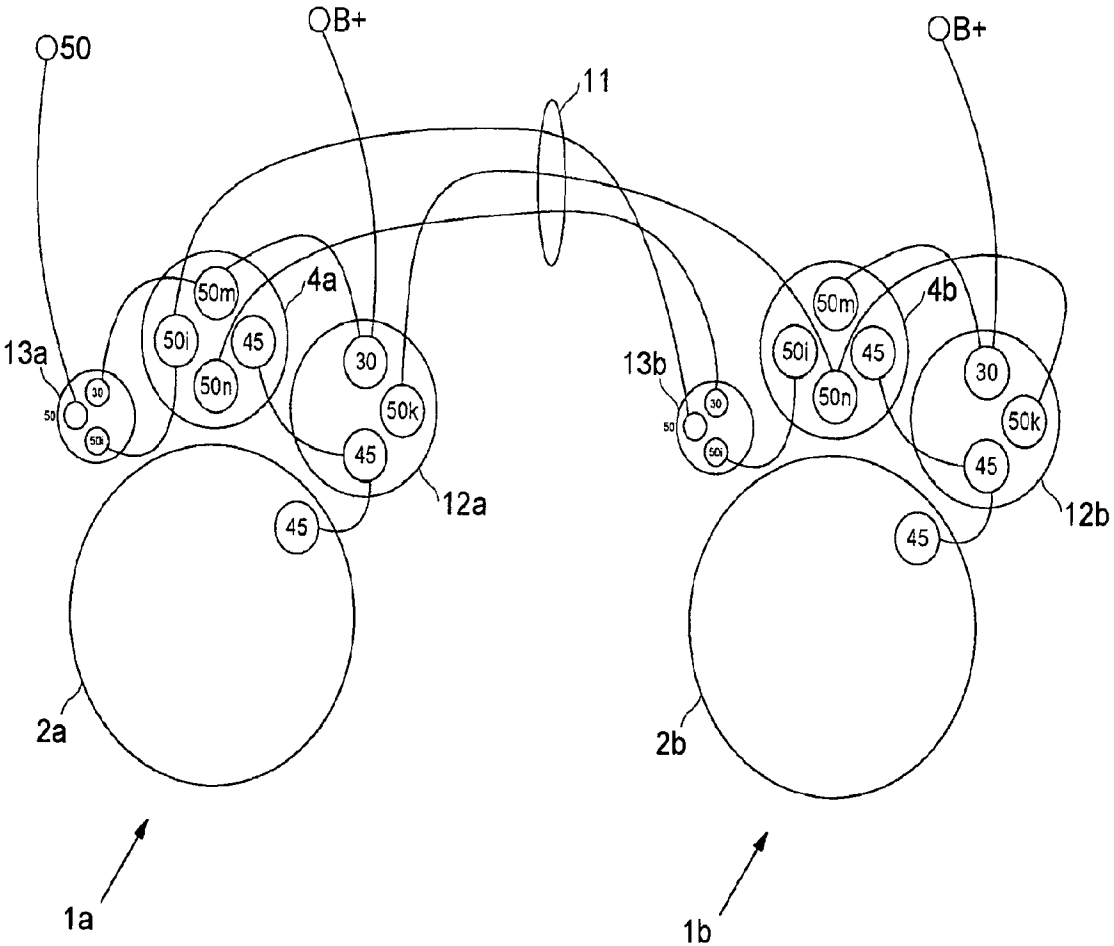
FIG. 3 shows the structural design of a parallel starting system according to FIG. 2.

FIG. 3 shows the physical configuration of the parallel starting system of FIG. 2. Each of starters 1*a*, 1*b* is designed as a structural unit, having a starter motor 2*a*, 2*b*, a starting relay 13*a*, 13*b*, an engaging relay 4, and a power relay 12*a*, 12*b*. Starters 1*a*, 1*b* in this case are connected with one another via a three-pole electrical lead 11.

Figure 4:
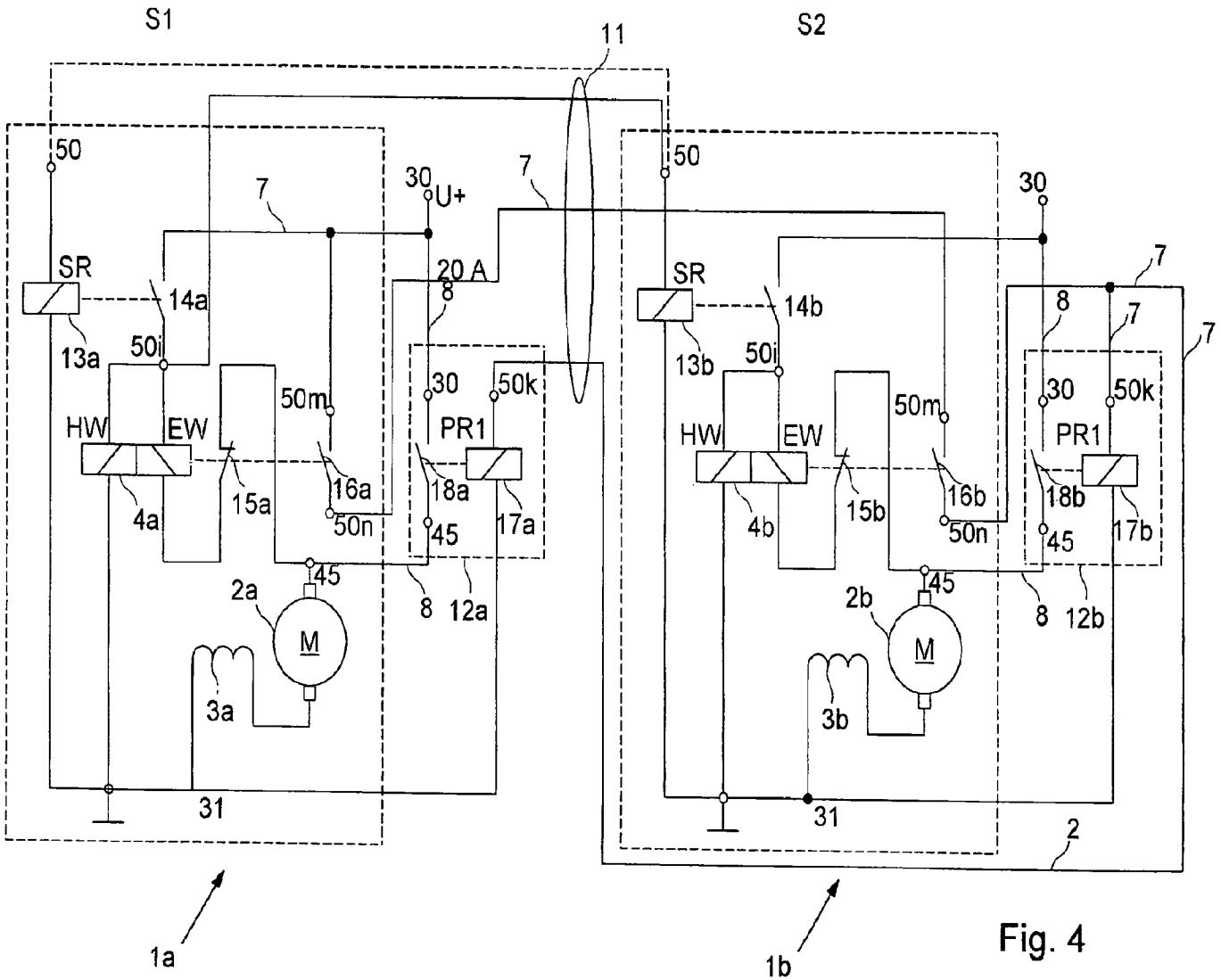
FIG. 4 shows the circuit diagram of a parallel starting system according to a second embodiment of the present invention.

FIG. 4 shows a parallel starting system having two starters 1*a*, 1*b* that essentially have the same configuration as the starters of FIG. 2. With respect to the explanation of the individual elements and their mode of functioning, reference is therefore made to the description regarding FIG. 2. In contrast to the system of FIG. 2, the load terminals (terminals 50*m*, 50*n*) of engaging relays 4*a*, 4*b* are interconnected in series. As a result, only a substantially lower control current of approximately 20 A flows in control line 7 between terminals 50*n* and 50*m*, making it possible to use a substantially thinner line.

Load switch 18*b* of engaging relay 4*b* is in turn connected to terminals 50*k* of power relays 12*a*, 12*b*, which are connected in parallel. The control terminals (terminal 50*i*) of engaging relays 4*a*, 4*b* are connected in parallel and each of them is connected to terminal 30 via load contact 14*a*, 14*b* of the starting relays.

Figure 5:
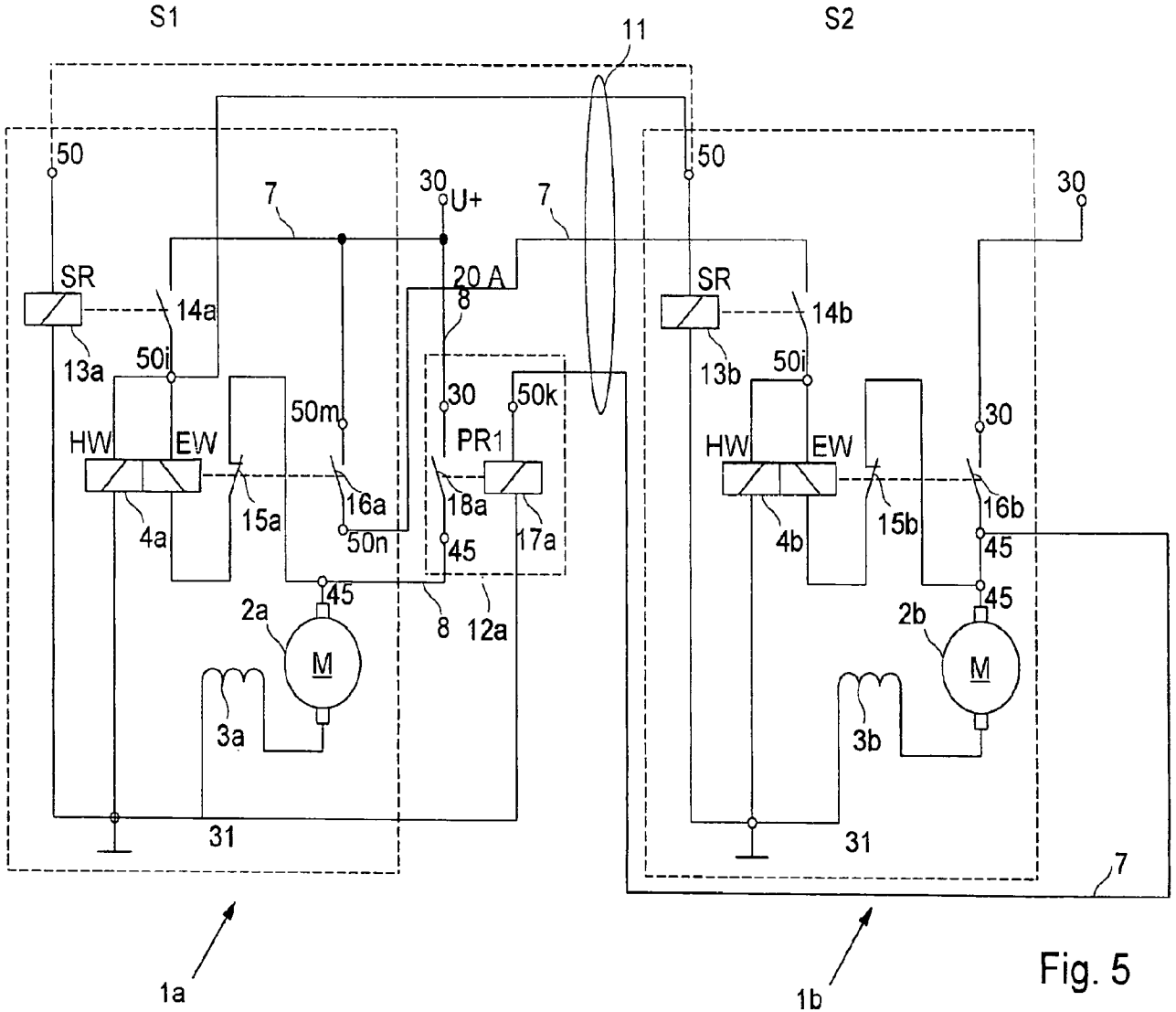
FIG. 5 shows the circuit diagram of a parallel starting system according to a third embodiment of the present invention.

FIG. 5 shows a third embodiment of a parallel starting system having two starters 1*a*, 1*b* connected in parallel similar to FIG. 2. In this version, however, only first starter 1*a* has its own power relay 12*a*. In contrast to FIG. 2, the primary current of starter motor 2*b* is switched by combined engaging relay 4*b*. Engaging relay 4*b* in this case operates a switch 16*b* which is connected between terminal 30 and terminal 45 of starter motor 2*b*. When contact 16*b* is closed, current is supplied to control terminal 50*k* of power relay 17*a*. Contact 18*a* switches the current for motor 2*a* with a slight time delay with respect to 16*b*. This version has the advantage that only one power relay 4 is needed. However, a slight time delay results when starting motors 2*a*, 2*b*, since engaging relay 4*b* first switches on motor 2*b* and only after that supplies current to series-connected power relay 12*a* which then switches the primary current to motor 2*a*.

Figure 6A:
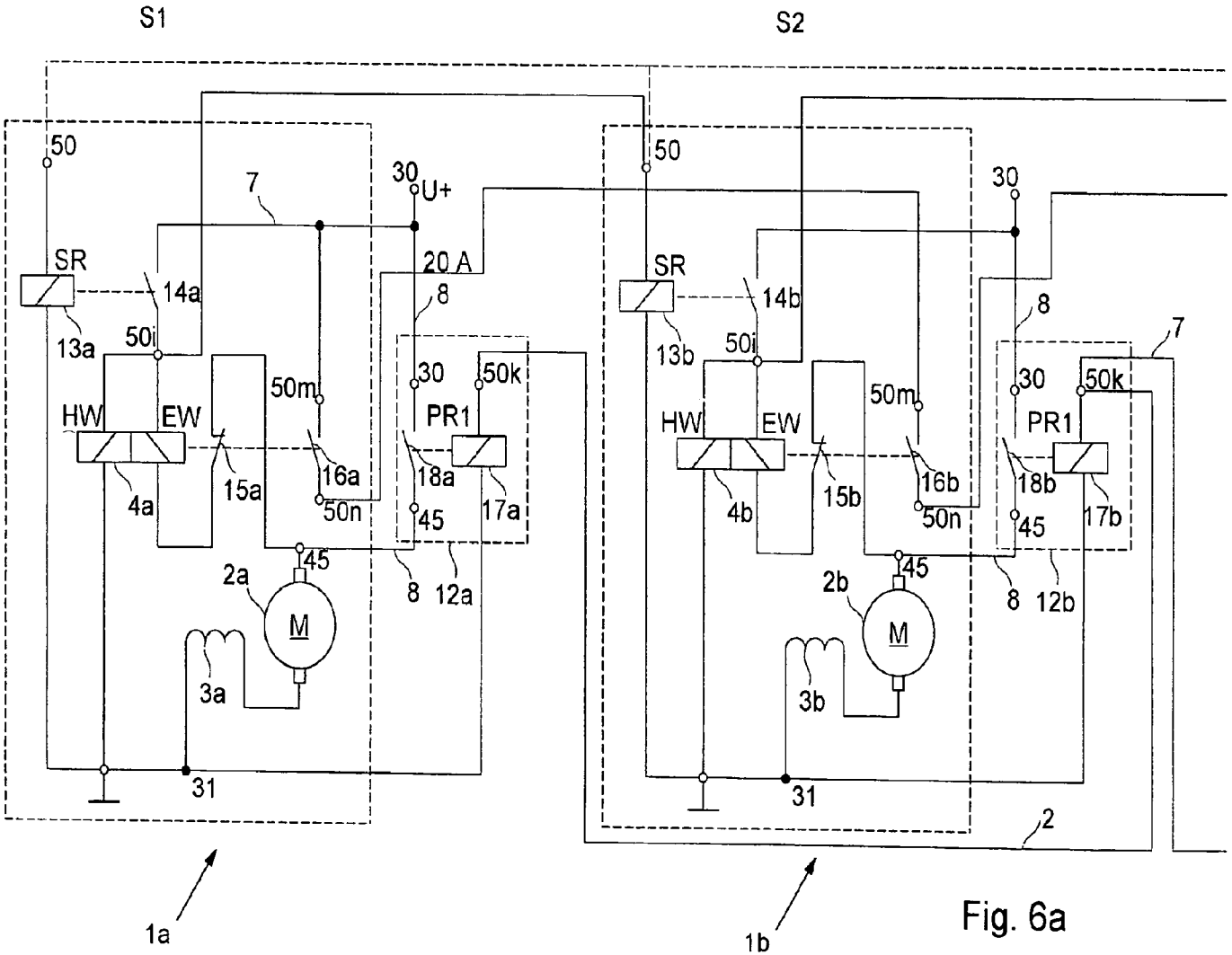
FIGS. 6*a* and 6*b* show the circuit diagram of a parallel starting system having three starters.
Figure 6B:
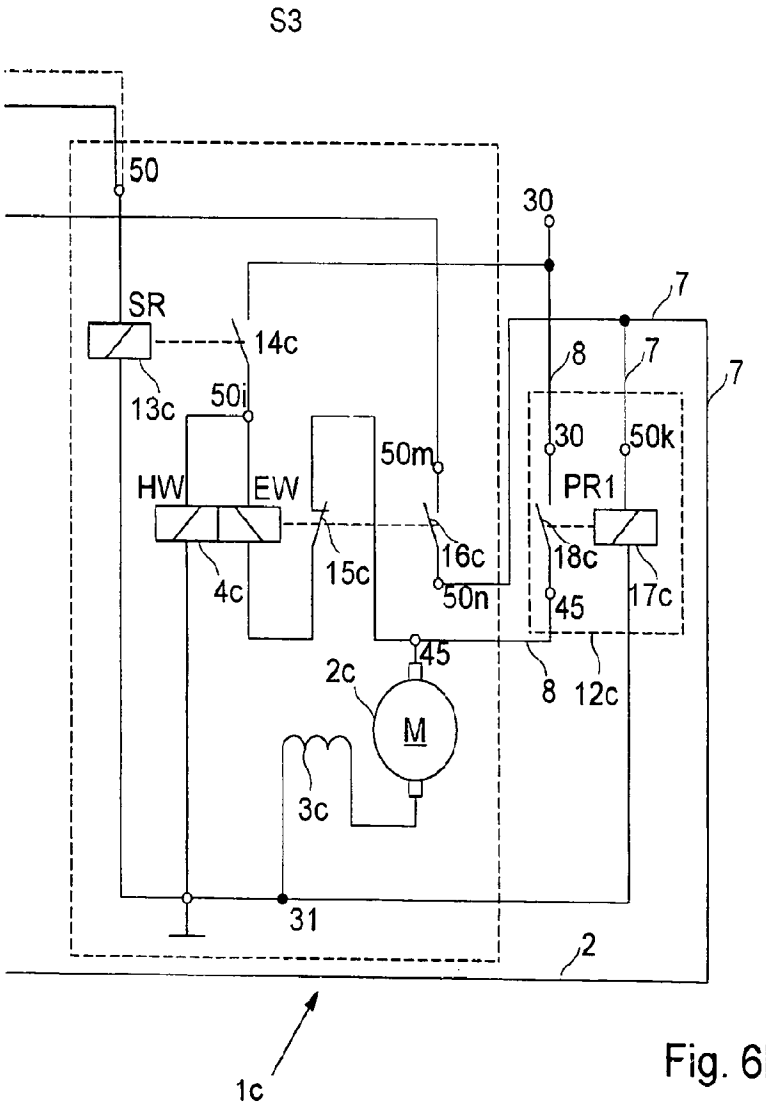

FIGS. 6*a* and 6*b* show a parallel connection of three starters 1*a*, 1*b*, and 1*c*. Optionally, even more starters 1 could be connected in parallel. The internal configuration of all starters 1 is identical. Only the external wiring is configured differently depending on the position of starter 1*a*, 1*b*, or 1*c* in the starter chain. In the case of a chain of n starters 1, all of the starters located in the middle are configured identically with regard to their external wiring. Only first and last starters 1*a* and 1*n* must be wired differently in this case. This may be implemented in a manner which is simple and cost-effective in particular.

LIST OF REFERENCE NUMERALS

1 Starter
2 Starter motor
3 Series winding
4 Engaging relay
5 Load switch of engaging relay 4
6 Starter switch
7 Control lead
8 Primary current lead
9 Ground wire
11 Connecting leads
12 Power relay
13 Starting relay
14 Load switch of the starting relay
15 Normally closed contact of the engaging relay.
16 Normally open contact of the engaging relay
17 Winding of the power relay
18 Load switch of power relay 12

What is claimed is:

1. A starter system for starting an internal combustion engine, comprising:

a plurality of starters connected in parallel, each having a starter motor and an engaging relay, the starters being connected by a plurality of three-pole electrical leads, wherein the engaging relays are connected in series and a load terminal of one of the engaging relays is interconnected with a control terminal of an adjacent engaging relay, wherein at least one of the starters has a power relay which switches a primary current path to the associated starter motor, and wherein the engaging relay, the power relay, and the starter motor are configured as a structural unit.

2. The starter system according to claim 1, wherein the starters are interconnected in such a way that the starter motors are not fully supplied with current until all engaging relays have pulled up.

3. The starter system according to claim 1, wherein each of the starters has a power relay, the power relays being connected in parallel and being connected in series to one of the engaging relays.

4. The starter system according to claim 1, wherein each three-pole electrical lead is situated in each instance between two of the starters.

5. The starter system according to claim 1, further comprising a plug connection situated in each instance between two of the starters.

6. The starter system according to claim 1, wherein the engaging relays engage a pinion with a ring gear to provide a starting current.

* * * * *